United States Patent [19]

Cowans et al.

[11] 4,016,314

[45] Apr. 5, 1977

[54] EMBROIDERED FRUIT BOWL WALL HANGING AND KIT FOR MAKING SAME

[75] Inventors: Beatrice L. Cowans; Virginia E. Hall, both of Washington, D.C.

[73] Assignee: Hallco Inc., Washington, D.C.

[22] Filed: June 26, 1975

[21] Appl. No.: 590,488

[52] U.S. Cl. ..... 428/35; D6/131; 46/116; 46/153; 156/61; 206/232; 248/27.8; 248/450; 428/21

[51] Int. Cl.[2] ..... A41G 1/00

[58] Field of Search ..... 40/160; 35/26; 2/247, 2/250; 112/266, 439; 156/63, 61; 428/13, 14, 15, 17, 21, 23, 35, 39, 67, 102, 104, 264, 274; 206/232; 248/27.8, 450; D6/130, 131; 46/116, 153

[56] References Cited

UNITED STATES PATENTS

| | | | |
|---|---|---|---|
| 366,405 | 7/1887 | Kopp | 112/266 X |
| 1,536,471 | 5/1925 | Bosshardt | 112/439 X |
| 2,552,274 | 5/1951 | Gentile | 428/90 X |
| 2,628,452 | 2/1953 | Gladstein | 2/250 X |
| 2,744,348 | 5/1956 | Smith | 428/23 X |
| 2,798,328 | 7/1957 | Fasino | 35/26 |
| 3,236,368 | 2/1966 | Eisen | 428/13 X |
| 3,269,032 | 8/1966 | Sumner | 35/27 X |
| 3,553,062 | 1/1971 | Berlin | 428/21 |
| 3,701,207 | 10/1972 | Conrad | 428/13 X |
| 3,849,911 | 11/1974 | Longenecker | 35/26 |

FOREIGN PATENTS OR APPLICATIONS

| | | | |
|---|---|---|---|
| 10,753 | 1885 | United Kingdom | 428/21 |
| 20,426 | 1891 | United Kingdom | 428/21 |

OTHER PUBLICATIONS

"Yarn and Burlap Picture Kits," page from the 1970 Catalog, of Arrow Handicracft Corporation, 1464 W. 37th Street, Chicago, Illinois, 60609.

*Primary Examiner*—George F. Lesmes
*Assistant Examiner*—Henry F. Epstein
*Attorney, Agent, or Firm*—Fred L. Denson

[57] ABSTRACT

A novel wall hanging which is a three-dimensional facsimile of a fruit bowl and kit for its fabrication are described. The hanging itself contains a backing board having a face side and a back side. A background burlap cover is tightly stretched over the front side of the backing board and the leftover edges of the background burlap cover are securely attached to the back side of the backing board by either glue, tape or other suitable means. A pocket is situated on a portion of the background burlap cover. The face of the pocket is attached to the background burlap cover and is a woven embroidered Strawtex in the shape of a fruit bowl. The back of the pocket is the portion of the background burlap cover underlying the face of the pocket. The pocket itself represents the inside of a fruit bowl into which various types of pieces of artificial fruit are disposed. Each piece of artificial fruit is individually made to the approximate three-dimensional size of the corresponding real fruit. The flesh portion of the fruit is made from cotton batting covered with Strawtex having a color similar to the fruit being simulated.

5 Claims, 10 Drawing Figures

EMBROIDERED FRUIT BOWL WALL HANGING AND KIT FOR MAKING SAME

BACKGROUND OF THE INVENTION

This invention relates to a novel article of manufacture useful as a wall hanging and to a kit for its preparation.

Several types of "do-it-yourself" kits are commonplace in the hobby market. Many of these kits include materials for making embroidered patterns which are useful for decorative purposes. U.S. Pat. No. 3,236,368 issued on Feb. 27, 1966 to M. Eisen, U.S. Pat. No. 3,269,032 issued on Aug. 30, 1966 to J. Sumner, U.S. Pat. No. 3,701,207 issued on Oct. 31, 1972 to E. H. Conrad and U.S. Pat. No. 2,798,328 issued on July 9, 1957 to E. De Frank Fasino all describe embroidered articles of manufacture which are made from kit materials. It is essential that any embroidering kit contain an attractive and useful end product. Moreover, the kit must contain clear, explicit instructions, and must be economical and practical to assemble i.e. it must be of such a nature that it can be assembled in a reasonable period of time to preclude the hobbyist from becoming bored or discouraged during the construction process. In order for the end product to be a successfully salable commodity, it must be aesthetically unique in all respects including balance and arrangement of color, pattern and subject matter.

OBJECTS OF THE INVENTION

It is therefore an object of this invention to provide a novel article of manufacture useful as a wall hanging.

It is another object of this invention to provide a kit for making an article of manufacture which is suitable for use as a wall hanging.

It is yet another object of this invention to provide an article of manufacture which is a "do-it-yourself" kit for making a fruit bowl which may be used as a wall hanging.

Another object of this invention is to provide a wall hanging which is a three-dimensional facsimile of a fruit bowl wherein the fruit appears real and natural.

A further object of this invention is to provide a novel structure for artificial fruit.

SUMMARY OF THE INVENTION

These and other objects of the invention are accomplished with a novel wall hanging which is a three-dimensional facsimile of a fruit bowl. The material for making the hanging is generally provided in a "do-it-yourself" kit form. The hanging itself contains a backing board having a face side and a back side. A background burlap cover is tightly stretched over the front side of the backing board and the leftover edges of the background burlap cover are securely attached to the back side of the backing board by either glue, tape or other suitable means. A pocket is situated on a portion of the background burlap cover. The face of the pocket is attached to the background burlap cover and is a woven embroidered Strawtex in the shape of a fruit bowl. The back of the pocket is the portion of the background burlap cover underlying the face of the pocket. The pocket itself represents the inside of a fruit bowl into which various types of pieces of artificial fruit are disposed. Each piece of artificial fruit is individually made to the approximate three-dimensional size of the corresponding real fruit. The flesh portion of the fruit is made from cotton batting covered with Strawtex having a color similar to the fruit being simulated. As previously mentioned, the invention is usually provided to the consumer in the form of a "do-it-yourself" kit. The kit is contained in a box which includes the backing board, the background burlap cover, an instruction sheet including a pattern for a fruit bowl, the inside of the fruit bowl being a pocket which results when the embroidered pattern is mounted on a portion of the background burlap cover, Strawtex of various colors, cotton batting, wire, burlap for embroidering purposes and optionally a pencil, needle and various types of tape.

The hanging itself is ideally suited for interior decorating in that is is very colorful and the bowl with the fruit has a real and natural appearance. Moreover, the product is admirable from the standpoint of having been handmade as a hobby.

DETAILED DESCRIPTION OF THE INVENTION

Figure 1:
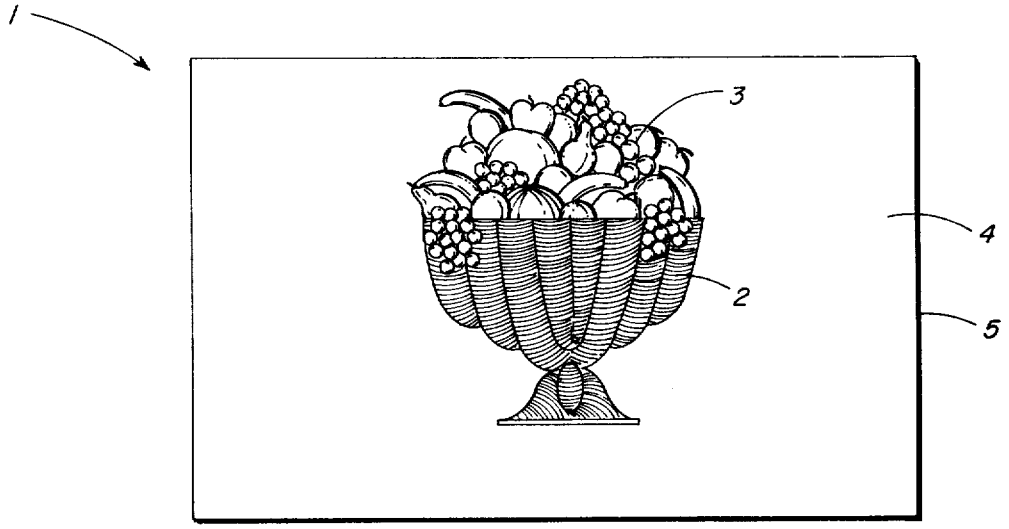
FIG. 1 is an overall view of the novel fruit bowl wall hanging of this invention.
Figure 4:
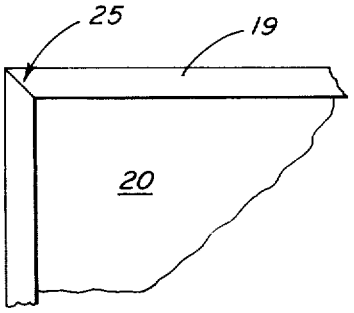
FIG. 4 is a partial rear view of a corner of the assembled novel fruit bowl hanging of FIG. 1.

In FIG. 1, the novel fruit bowl hanging of this invention 1 contains a background burlap cover 4 which is tightly stretched over backing board member 5. Background burlap cover 4 is secured to backing board member 5 by taping, pasting or fastening by other suitable means the leftover edges of the burlap onto the back side of the backing board member 5. Fruit bowl 2 is embroidered with Strawtex from a corresponding pattern and is mounted in such a manner than its top is left open to form a pocket simulating the inside of a fruit bowl into which pieces of various types of artificial fruit 3 are placed. Artificial fruit 3 may be any of a variety of well known fruits which are commonly found in real fruit bowls such as bananas, grapes, cherries, plums, grapefruit, oranges, tangerines, peaches, lemons, pears, apples, etc. As shown in FIG. 4, the leftover edges 19 of the background burlap cover (4 of FIG. 1) are securely attached to the back side 20 of backing board member 5. The corners 25 of the material are mitered to form a neat secure fitting.

Figure 6:
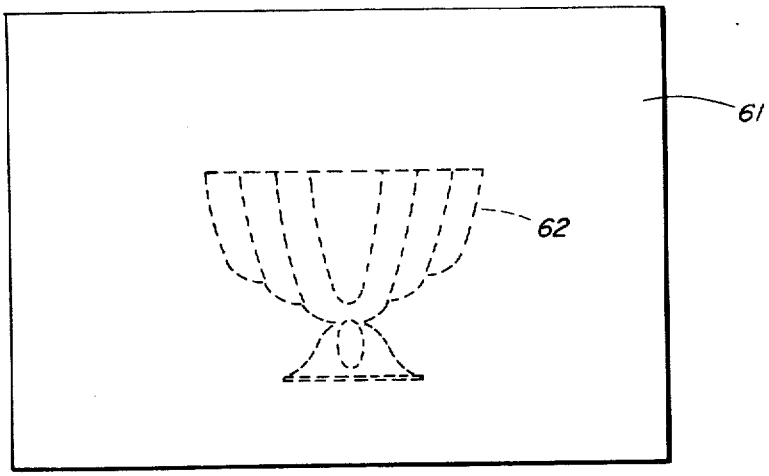
FIG. 6 is an orthographic view of a fruit bowl pattern prior to embroidering.
Figure 7:
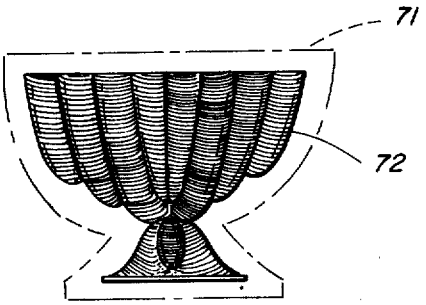
FIG. 7 is an orthographic view of an embroidered fruit bowl resulting from embroidering the pattern of FIG. 6.

Ordinarily, the fruit bowl is made first by centering pattern 62 on burlap 61 as shown in FIG. 6. While the burlap can be of any size material 17 × 27 inches is very suitable. Pattern 62 representing the bowl is secured to burlap 61 by stapling, tacking or other suitable means. The pattern is then embroidered with Strawtex to form fruit bowl 72 as shown in FIG. 7. In order not to waste Strawtex, the face only of the material is embroidered. After the fruit bowl is embroidered, the unfinished edges are trimmed to approximately 1 inch to 1½ inches to form border 71 of FIG. 7 which is clipped at the curves and turned under to form smooth and neat edges.

Figure 8:
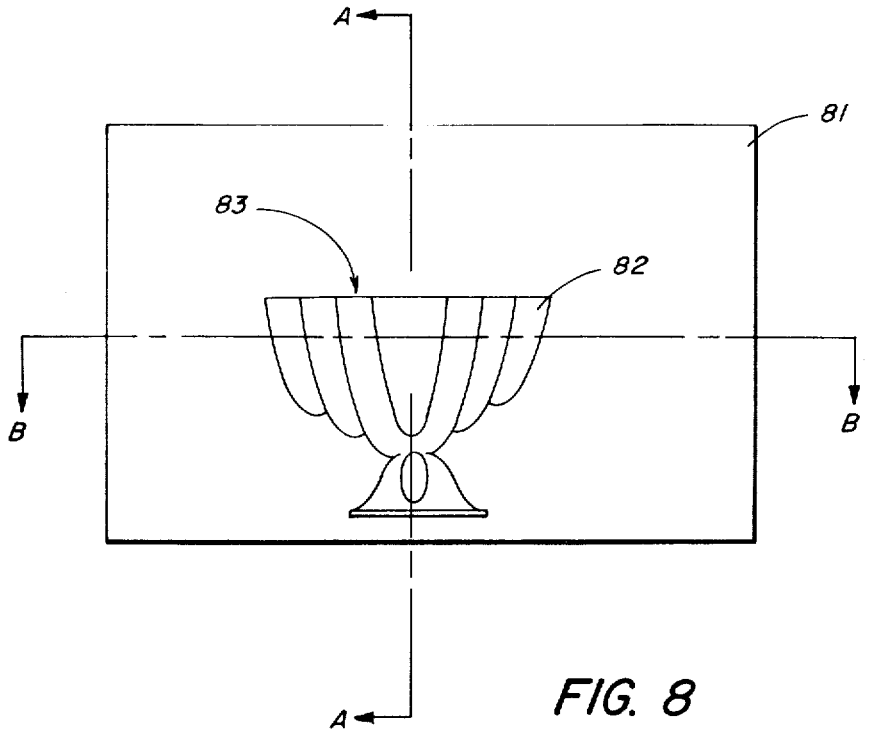
FIG. 8 is an assembly view of an embroidered fruit bowl mounted on a background burlap cover.
Figure 9:
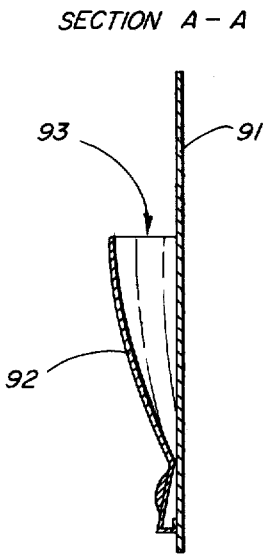
FIG. 9 is a sectional view taken along line A—A of FIG. 8.
Figure 10:
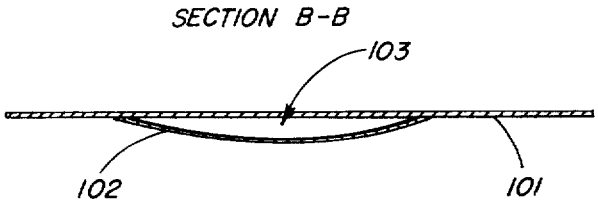
FIG. 10 is a sectional view taken along line B—B of FIG. 8.

As shown in FIG. 8, embroidered fruit bowl 82 is attached within predetermined lines on background burlap cover 81. Background burlap cover 81 can be of any size but for convenient use in kit form is generally about 46 inches by 36 inches. The sides and bottom of bowl 82 are attached to cover 81 while the top is left open to provide a pocket 83 simulating the inside of a bowl into which various types of artificial fruit are placed. FIG. 9 shows pocket 93 formed by bowl 92 and cover 91. FIG. 10 also shows pocket 103 representing the inside of the fruit bowl 102 and cover 101. The bottom inside of the bowl is tacked to the background burlap cover to maintain it in position. As previously explained, the bowl and cover are then stretched as tightly as possible across the backing board member and the left over edges are affixed to the back of the backing board as shown in FIG. 4.

Figure 5:
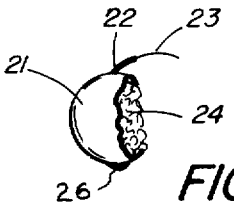
FIG. 5 is a cut away view of the structure of a piece of artificial fruit used in the assembled novel fruit bowl hanging of FIG. 1.

The structure of a piece of artificial fruit 21 is shown in FIG. 5. Fruit 21 has bud end 26 and stem end 22. The body of the fruit is formed by shaping cotton batting 24 to the approximate shape of the fruit and thereafter covering it with the appropriate colored Strawtex simulating the color of the fruit. Stem end 22 is generally formed by partially inserting wire 23 into the body of the fruit and wrapping the exposed end with green floral tape. The bud end 26 of the fruit is usually made by folding and twisting a piece of Strawtex of the appropriate color and securing the same in position by a wire support. While a fruit of relatively round shape has been shown in FIG. 5, it is understood that a fruit of any configuration such as bananas, grapes, cherries, plums, grapefruits, oranges, tangerines, peaches, lemons, pears, apples, etc. can be used in this invention.

Figure 2:
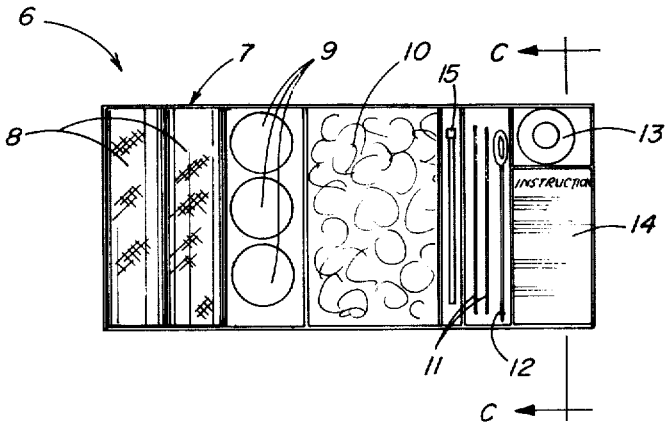
FIG. 2 is a plan view of a kit containing the component parts for making the novel fruit bowl wall hanging of this invention.
Figure 3:
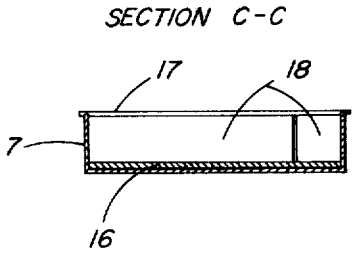
FIG. 3 is a sectional view taken along line C—C of FIG. 2.

FIG. 2 shows the invention in a "do-it-yourself" kit 6. Kit 6 includes container 7, two pieces of burlap 8 (one large piece used as the background cover and a second smaller piece used for embroidering purposes), Strawtex 9 of various colors, cotton batting 10, wire 11, needle 12, floral tape 13, instructions 14 with pattern and pencil 15. FIG. 5 shows backing board member 16 disposed in the bottom of the kit container 7. The top of the kit is covered with any clear material 17 such as cellophane to permit visual inspection of the materials contained in the various compartments 18 of the kit.

EXAMPLES OF PREPARATION OF ARTIFICIAL FRUIT PIECES

Various techniques may be used for making the different types of fruit which are disposed within the pocket of the embroidered fruit bowl. The examples set forth below are for illustrative purposes only and are not limiting with respect to the invention.

Bananas

Bananas are typically made by cutting cotton batting in a 10 inch length and shaping it to the desired size. Thereafter, seven strips of 14 inches long Strawtex are taped together lengthwise. This procedure is repeated two additional times so that three layers of Strawtex are obtained. One of the layers of the yellow Strawtex is rolled lengthwise around the cotton batting and taped. A second layer of the yellow Strawtex is also wrapped around the cotton batting and taped. Thereafter, two strips of brown Strawtex each 14 inches long are twisted and taped at each end and in the center. The Strawtex is then taped approximately 1 and 1½ inches apart around the bananas to similate the brown portion of the banana. The third layer of yellow Strawtex is wrapped around the banana and taped. A yellow strip of Strawtex 5 inches long is cut lengthwise in half, twisted and tied to the ends of the banana. Green floral tape is thereafter taped around each end of the artificial banana. Two additional strips of brown Strawtex 3 inches long are cut and folded in half lengthwise. Each strip is wrapped around each end of the artificial banana over the floral tape and taped down with clear, smooth adhesive tape. The banana is finalized by trimming excess edges.

Grapes & Cherries

Artificial grapes and cherries are typically made by forming cotton batting around an 8 inch piece of wire to the desired size for the grapes or cherries. Thereafter, four 6 inch strips of Strawtex of the desired color are wrapped around the batting. The ends of the Strawtex are twisted together around the stem and tied with a 3 inch strip of Strawtex to hold it firm. Strawtex is also used to wrap about 1½ inches along the stem leaving the balance of the stem wire bare. Floral tape is used to wrap the balance of the stem wire.

Plums

Artificial plums are made by forming cotton batting around an 8 inch piece of wire to the desired size. Fourteen 7 inch strips of Strawtex are stacked on top of each other and tied in the center with a 3 inch strip of Strawtex. The strips are then fanned from the center and shaped over the cotton batting. The loose ends are held together around the stem and tied securely with a 3 inch piece of Strawtex. The excess is trimmed and the remainder wrapped with green floral tape around the stem.

Grapefruit, Oranges, Tangerines, Peaches, Lemons

Cotton batting is wrapped around a pencil until the desired size and shape is achieved for the particular fruit being reproduced. A strip of Strawtex 3 inches in length is taped to one end of the pencil and drawn through the center of the shaped cotton batting. Strawtex is then pushed through the opposite end of the fruit with the eraser end of the pencil. This step is repeated until the cotton batting is completely wrapped with Strawtex and the fruit is completely covered. Thereafter, the Strawtex is tied at the bottom and top with a 3 inch piece of Strawtex. When the artificial fruit being reproduced is either lemons, tangerines, or grapefruit then the ends of the Strawtex are tied with green Strawtex in order to make a reproduction which most nearly resembles the fruit being simulated.

Pears & Apples

Pears and apples are prepared by wrapping cotton batting around a pencil until the desired size and shape are formed. Four 6 inch strips of Strawtex are cut and one end of one piece of Strawtex is taped to the end of the pencil and drawn through the center of the batting.

The tape is removed from the pencil and the Strawtex is taped to the cotton batting. The Strawtex is then brought around the outside of the cotton batting and pushed through the center of the pear or apple with the eraser end of the pencil. Strawtex is continuously pushed through the center of the fruit by spreading it with the thumbs to further open it and is wrapped around the cotton batting until the pear or apple is completely covered. The bud end of an artificial apple is prepared from green Strawtex and from brown Strawtex for a pear. Bud ends are assimilated by cutting one 4 inch strip of green Strawtex and folding it in half crosswise two times. The Strawtex is twisted in the middle three times. A 3 inch length of wire is folded in half and looped around the center twist of Strawtex. Thereafter, the wire is twisted and the Strawtex is cut even on both ends. The Strawtex is folded together and 1/16 inch is clipped on the ends. Green floral tape is wrapped around the Strawtex at the bottom and around the wire. Thereafter, the wire is inserted into the bud end of the apple or the pear. Stem ends are provided for apples and pears by cutting one 4 inch piece of green Strawtex and one 4 inch piece of wire. The Strawtex is twisted lengthwise around the wire and folded in half. Green floral tape is wrapped around the bottom end of the Strawtex and the wire. Thereafter, the center is parted to make an eye and the wire is inserted into the stem end of the pear or apple.

The kit of this invention is easily assembled within a few hours time. Also, the assembled product provides a useful decoration that can be used where wall hangings are employed. As previously mentioned, the individual pieces of fruit that are placed in the bowl can be of any size depending upon the desires of the person. The pocket portion or inside of the bowl will be of a size commensurate with the size of the bowl itself, usually, however, the pocket will have an opening of from about 5 to about 7 inches in diameter. The fruit may be placed loosely into the bowl as individual pieces or in certain cases, it may be tacked to the burlap backing to better secure it. It will be apparent that the kit of this invention affords a relatively economical medium for a "do-it-yourself" leisure, that is interesting, amusing, offers the user an opportunity to exercise manual skill and artistic taste, and provides the person finishing the decoration with a valuable, useful, ornamental and decorative end product.

The invention has been described in detail with particular reference to certain preferred embodiments thereof, but it will be understood that variations and modifications can be effected within the spirit and scope of the invention.

We claim:

1. An article of manufacture suitable for use as a wall hanging comprising:

a. a backing board having a face side and a back side;

b. a background burlap cover tightly stretched over the front side of the backing board and fixedly attached to the back side of the backing board;

c. a pocket situated on a portion of the background burlap cover, the face of said pocket being attached to the background burlap cover and comprising woven embroidered Strawtex in the shape of a fruit bowl and the back of said pocket comprising the portion of the background burlap cover underlying the face of the pocket; and d. at least one artificial fruit piece disposed within said pocket and comprising cotton batting covered with Strawtex having a color similar to the fruit being simulated.

2. The article of claim 1 wherein the artificial fruit piece includes an artificial bud end comprising an appropriately colored, folded and twisted piece of Strawtex secured to the fruit piece by a wire support.

3. The article of claim 1 wherein the artificial fruit piece includes an artificial stem end comprising a wire covered with an appropriately colored piece of Strawtex, wherein a portion of said wire is inserted into said fruit piece.

4. A kit for making an article of manufacture suitable for use as a wall hanging comprising:

a. a backing board having a face side and a back side;

b. a background burlap cover designed to be tightly stretched over the front side of the backing board and fixedly attached to the back side of the backing board;

c. an instruction sheet including a pattern for a pocket designed to be situated on a portion of the background burlap cover, the face of said pocket to be attached to the background burlap cover and comprised of embroidered Strawtex in the shape of a fruit bowl and the back of said pocket to be comprised of the portion of the background burlap cover underlying the face of the pocket;

d. burlap material for embroidering a fruit bowl pattern;

e. Strawtex of various colors;

f. cotton batting; and g. wire.

5. The kit of claim 4 including a pencil, a needle and floral tape.

* * * * *